United States Patent [19]

Munsey et al.

[11] Patent Number: 4,729,859

[45] Date of Patent: Mar. 8, 1988

[54] METHOD FOR CASTING CONCRETE PANELS

[75] Inventors: R. Jack Munsey, Caledonia; Leroy D. DeJong, Spring Lake; Charles P. Keip, Grandville, all of Mich.

[73] Assignee: C-Tec, Inc., Grand Rapids, Mich.

[21] Appl. No.: 912,805

[22] Filed: Sep. 29, 1986

Related U.S. Application Data

[62] Division of Ser. No. 743,987, Jun. 12, 1985, Pat. No. 4,639,204.

[51] Int. Cl.[4] ..... B28B 1/08; B28B 1/20

[52] U.S. Cl. ..... 264/71; 264/267; 264/274; 264/275; 264/311; 425/125; 425/432; 425/451.9

[58] Field of Search ..... 52/126.6; 264/70, 72, 264/310, 311, 279, 70, 274, 275, 278, 108, 46.7, 35, 267; 425/89, 125, 429, 430, 432, 3, 451.9, 425; 249/112, 219 R

[56] References Cited

U.S. PATENT DOCUMENTS

| | | | |
|---|---|---|---|
| 1,540,570 | 6/1925 | Roberts | 249/219 R |
| 1,794,503 | 3/1931 | Underwood | 264/72 |
| 1,845,711 | 2/1932 | Honig et al. | 52/598 |
| 1,984,197 | 12/1934 | Page | 264/72 |
| 2,154,036 | 4/1939 | Doherty | 52/599 |
| 2,474,660 | 6/1949 | Fitzpatrick | 264/42 |
| 2,860,379 | 11/1958 | Beckadolph et al. | 425/82 |
| 3,012,298 | 12/1961 | Ramsey et al. | 425/429 |
| 3,038,231 | 6/1962 | Bergesen et al. | 425/262 |
| 3,200,180 | 8/1965 | Russ et al. | 264/102 |
| 3,234,315 | 2/1966 | Blue et al. | 264/310 |
| 3,301,925 | 1/1967 | Engel | 264/37 |
| 3,391,423 | 7/1968 | Charvat et al. | 425/4 R |
| 3,522,686 | 8/1970 | Gordon et al. | 52/745 |
| 3,561,375 | 9/1971 | Hammond et al. | 108/53 |
| 3,619,441 | 11/1971 | Burchett | 264/71 |
| 3,622,656 | 11/1971 | Dewey, Jr. et al. | 264/35 |
| 3,742,109 | 6/1973 | Zijp et al. | 264/311 |
| 3,756,762 | 9/1973 | Maugweiler | 425/258 |
| 3,759,009 | 9/1973 | Ransome | 52/598 |
| 3,778,206 | 12/1973 | Barratt | 425/86 |
| 3,914,361 | 10/1975 | Shiina et al. | 264/45.4 |
| 3,942,924 | 3/1976 | Schwartz | 425/110 |
| 3,995,685 | 12/1976 | Stanko | 164/386 |
| 4,035,967 | 7/1977 | Harvey | 52/126.6 |
| 4,085,557 | 4/1978 | Tharp | 52/126.6 |
| 4,094,624 | 6/1978 | Halm | 425/434 |
| 4,143,193 | 3/1979 | Rees | 428/35 |
| 4,250,128 | 2/1981 | Meckling | 264/24 |
| 4,284,447 | 8/1981 | Dickens et al. | 156/78 |
| 4,294,792 | 10/1981 | Arons et al. | 264/311 |
| 4,324,037 | 4/1982 | Grady, II | 264/274 |
| 4,342,713 | 8/1982 | Larkfeldt | 264/71 |
| 4,534,924 | 8/1985 | Kariakin | 264/274 |
| 4,593,499 | 6/1986 | Kobayashi et al. | 52/126.6 |
| 4,606,156 | 8/1986 | Sweers et al. | 52/263 |

*Primary Examiner*—Jan H. Silbaugh
*Assistant Examiner*—Karen D. Kutach
*Attorney, Agent, or Firm*—Price, Heneveld, Cooper, DeWitt & Litton

[57] ABSTRACT

A method for centrifugally casting a rectangular access floor panel includes the steps of forming a metal pan having a planar bottom, peripheral sidewalls and a plurality of upstanding tabs, inserting the metal pan into a cavity defined by a two-part mold and filling the pan within the mold with a concrete mixture. The mold is rotated about a vertical axis and vibrated to evenly distribute the concrete mixture within the pan. A smooth magnetic sheet is placed within the cavity. The sheet engages the planar bottom of the metal pan and prevents seepage of the concrete mixture through openings in the bottom of the pan during casting. The apparatus includes a turntable, a drive for rotating the turntable and a mold clamped to the turntable. The mold is vibrated during rotation to insure a void-free distribution of the mixture throughout the pan.

4 Claims, 12 Drawing Figures

METHOD FOR CASTING CONCRETE PANELS

CROSS REFERENCE TO RELATED APPLICATION this is a division of application Ser. No. 743,987, filed June 12, 1985, and now U.S. Pat. No. 4,639,204.

BACKGROUND OF THE INVENTION

The present invention relates to flooring systems and more particularly to an apparatus and method for manufacturing access floor panels and other like products.

In many installations, it is necessary or desirable to include an access floor system which is elevated above the structural floor of a building. The space between the structural floor and the access floor system contains power cables, communication cables, heating, cooling and ventilation equipment, communication equipment and the like. The raised floor system permits easy installation, renovation and interconnection of a wide variety of systems, such as computer equipment and the like.

A typical access floor system includes a plurality of floor panels supported on pedestals. A typical panel is approximately two feet square. The panel is supported at its corners on the pedestals which rest on the structural floor. Bridge channels or stringers are sometimes installed between the pedestals to provide lateral stability and increased strength.

Various forms of floor panels have heretofore been proposed. The panels may be of wood structure or of a high density composite core having galvanized steel sheets laminated to opposite floor surfaces. In this latter form, channels are sometimes welded to the perimeter of the steel sheets. These forms of panels have a high cost-to-strength ratio. Other forms of panels include a cement mixture core and metal cover sheets. These systems suffer from various problems, including difficulty of manufacture, high cost and insufficient strength or stability. Examples of prior systems may be found in U.S. Pat. No. 3,759,009, entitled COMPOSITE LOAD BEARING PANELS and issued on Sept. 18, 1973 to Ransome; U.S. Pat. No. 2,154,036, entitled CONSTRUCTIONAL FINISH DETAIL ELEMENT and issued on Apr. 11, 1939 to Doherty; and U.S. Pat. No. 1,845,711, entitled TILE AND FLOOR WITH SPECIAL METAL WEARING SURFACE and issued on Feb. 16, 1932 to Honig.

Commonly owned U.S. patent application Ser. No. 519,468, entitled ACCESS FLOORING PANEL and filed on Aug. 4, 1983 by Sweers et al, now U.S. Pat. No. 4,606,156, discloses a unique panel which solves most of the aforementioned problems. The panel includes a lanced metal pan having tabs oriented generally radially inwardly toward a central portion of the pan. The pan is filled with a lightweight concrete mixture which encapsulates the tabs. The direction of the lances and the construction prevents ripping of the tabs under load. The metal pan provides tensile strength, and the concrete mixture provides compressive strength.

Heretofore, many problems have been experienced with the mass production of access floor panels which include a metal pan filled with a cement or concrete mixture. Prior production methods have been labor intensive. In one approach, the metal pan is disposed in an overfill mold. The concrete mixture is distributed within the mold and hand troweled. After the core cures, the panel must be ground to a smooth, level surface. Difficulties are encountered with achieving relatively high production rates and obtaining the necessary quality.

SUMMARY OF THE INVENTION

In accordance with the present invention, the aforementioned problems are substantially eliminated. Essentially, the present invention includes an apparatus and method for the mass production of composite access floor panels of the type including a metal pan and concrete core. The apparatus includes a turntable supporting a mold and means for spinning the turntable about a vertical axis with the mold in a generally horizontal plane. A concrete mixture is poured into the mold and, where advisable, fills a metal pan or other reinforcing member positioned within the mold. The concrete mixture is rotationally cast. Provision is made for vibrating the mold during the casting operation. The rotation of the mold centrifugally casts the panel, resulting in a uniform distribution of the concrete mixture. Secondary manufacturing steps, such as grinding operations, are eliminated.

The method of manufacturing the access floor panels includes the steps of providing a metal pan or reinforcing member, placing the pan within a mold, filling the mold with a concrete mixture while rotating the mold. In addition, corner pads or core pieces may be inserted within the mold along with spacer buttons. The corner pads are configured to provide pedestal pads plus eliminate the need for stringers or the like to achieve lateral stability.

The method and apparatus in accordance with the present invention results in substantial increases in production rates, a significant reduction in manpower or labor requirements and an improvement in the overall quality of the resulting panel. Reduced costs, increased quality and increased ease of installation are achieved.

DETAILED DESCRIPTION OF THE PREFERRED EMBODIMENT

Figure 2:
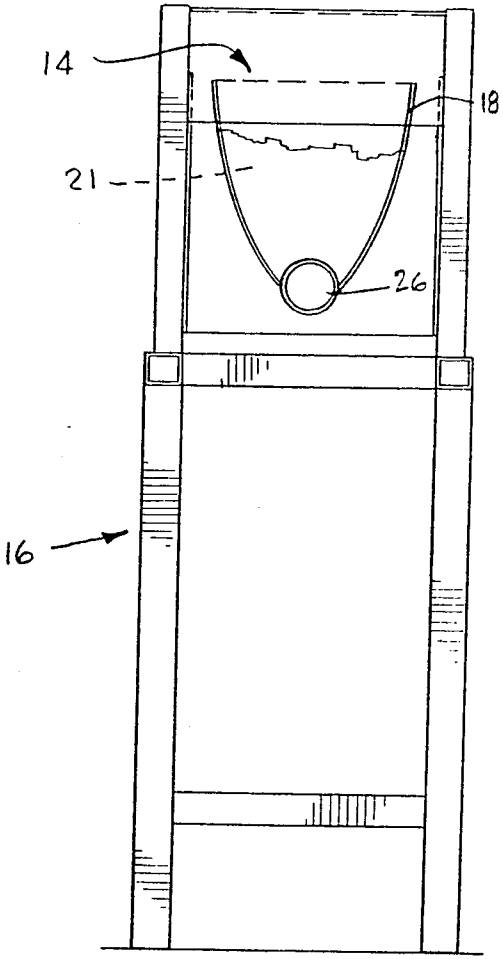
FIG. 2 is a right, end elevational view of a portion of the apparatus of FIG. 1.
Figure 1:
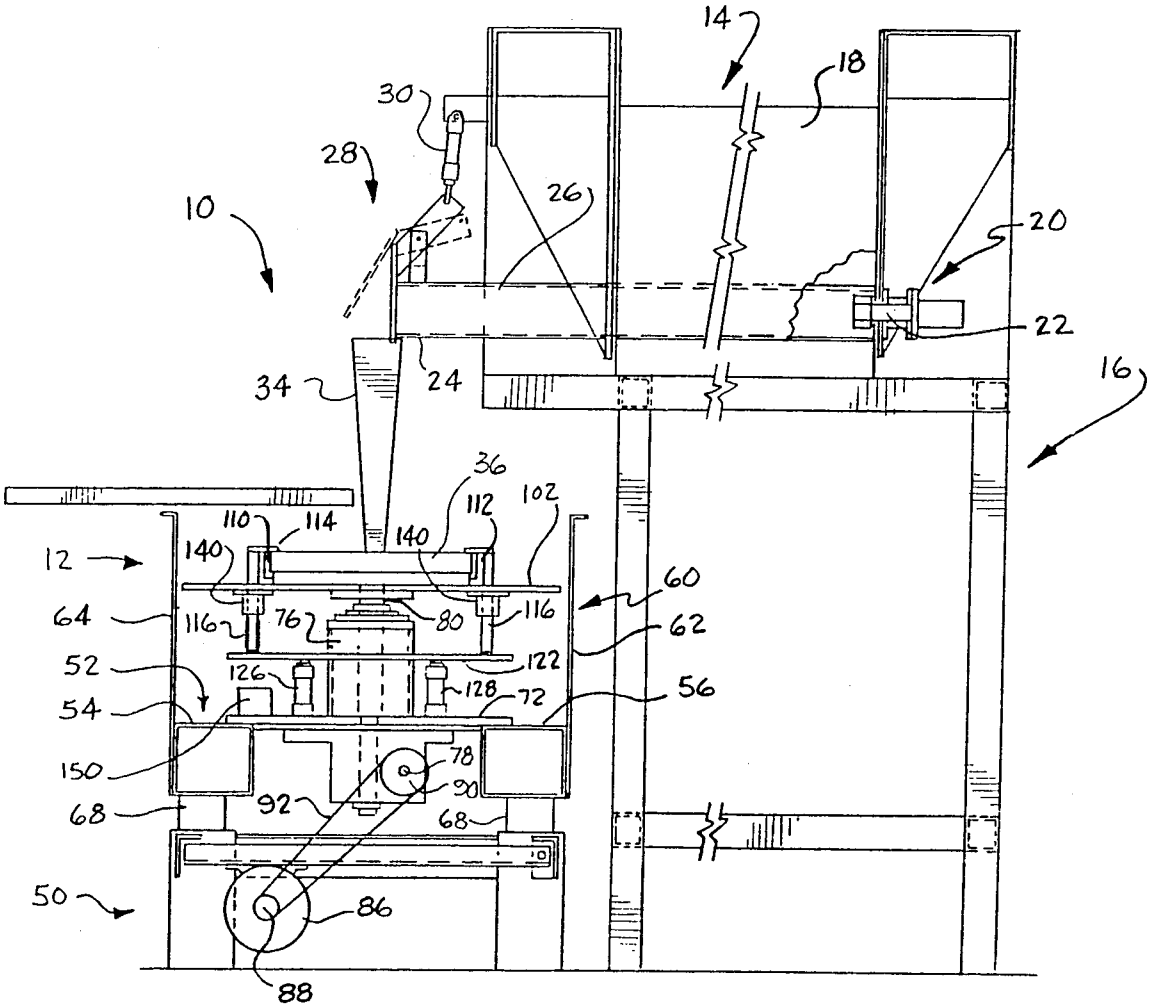
FIG. 1 is a schematic, side elevational view of an apparatus for manufacturing access floor panels in accordance with the present invention.

A preferred embodiment of an apparatus for manufacturing composite access floor panels in accordance with the present invention is illustrated in FIG. 1 and generally designated 10. Apparatus 10 includes a spinner or centrifugal casting apparatus generally designated 12 and a concrete mix or "mud" supply hopper 14. Hopper 14 is supported on a frame 16. Hopper 14 includes a bin 18 and a discharge assistant or metering means 20. Bin 18 contains a concrete mixture 21 (FIG. 2). Discharge assistant 20 includes a shaft 22. Rotation of shaft 22 forces concrete mixture from bin 18 through the discharge opening or outlet 24 of a tube 26. A pivotal valve structure 28 is movable from a closed position to an open position, illustrated in phantom lines in FIG. 1, by a piston cylinder actuator 30. When valve 28 is open, a metered amount of concrete mixture is discharged from outlet 24 into a sprue 34. As explained in more detail below, sprue 34 directs the concrete mixture to a mold 36. Mold 36 is a thin cavity, generally rectangular mold. Mold 36 is supported in a horizontal plane by the centrifugal casting subassembly 12.

Centrifugal Casting Subassembly

Figure 3:
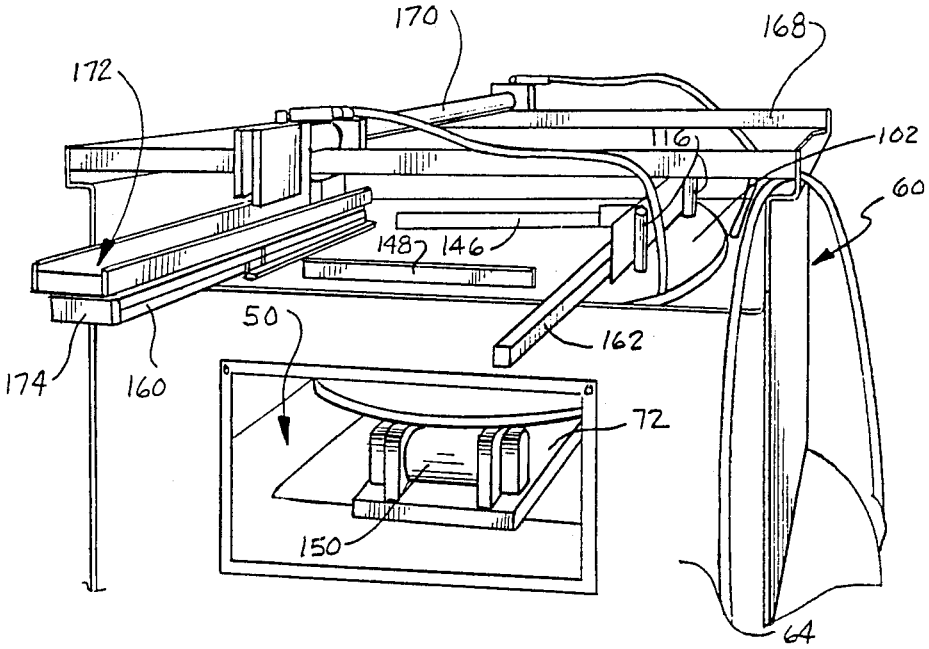
FIG. 3 is an enlarged, front end, perspective view of the centrifugal casting subassembly included in the apparatus of FIG. 1.
Figure 4:
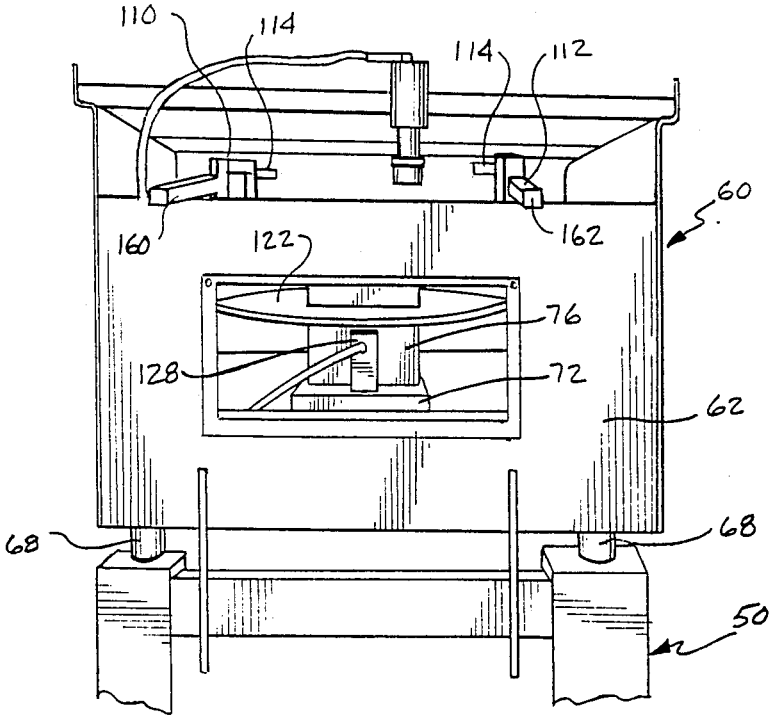
FIG. 4 is a rear, elevational view of the apparatus of FIG. 3.

Centrifugal casting subassembly 12 is best seen in FIGS. 1 and 3–7. Subassembly 12 includes a support frame or base structure 50 and an upper frame 52 including side members 54, 56. A housing 60 including walls 62, 64 is secured to upper frame 52. Upper frame 52 is supported on base frame 50 by a plurality of rubber blocks or vibration isolators 68 (FIGS. 1 and 4). Extending between members 54, 56 of upper frame or support 52 is support or mounting plate 72 (FIGS. 1 and 4). Secured to plate 72 is a drive housing 76. Housing 76 supports an input shaft 78 and a vertical output shaft 80. Shaft 78 is connected to shaft 80 by suitable gearing enclosed within the housing. Supported on base 50 is a variable speed drive motor 86. Drive motor 86 is operably connected to input shaft 78 by sprockets or pulleys 88, 90 and a flexible drive transmission means, such as a chain or belt 92.

Figure 6:
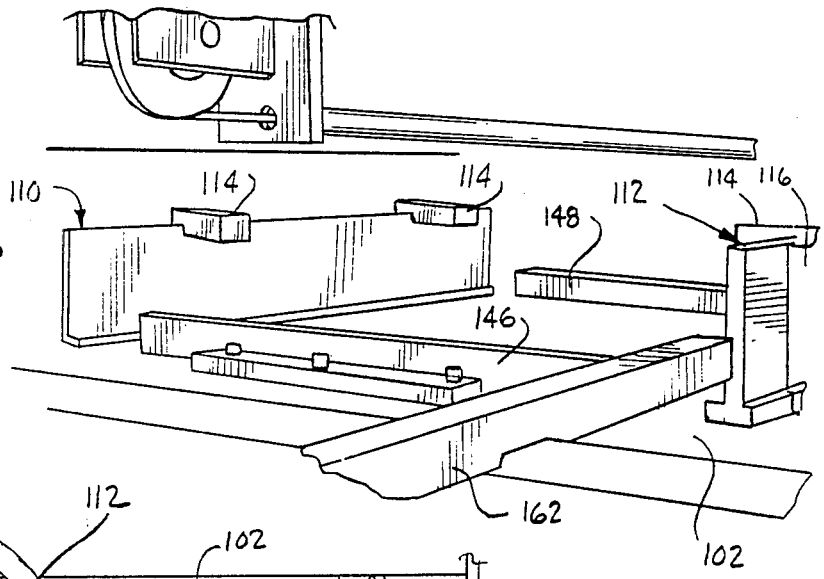
FIG. 6 is an enlarged, fragmentary, perspective view showing the mold clamp subassembly.
Figure 7:
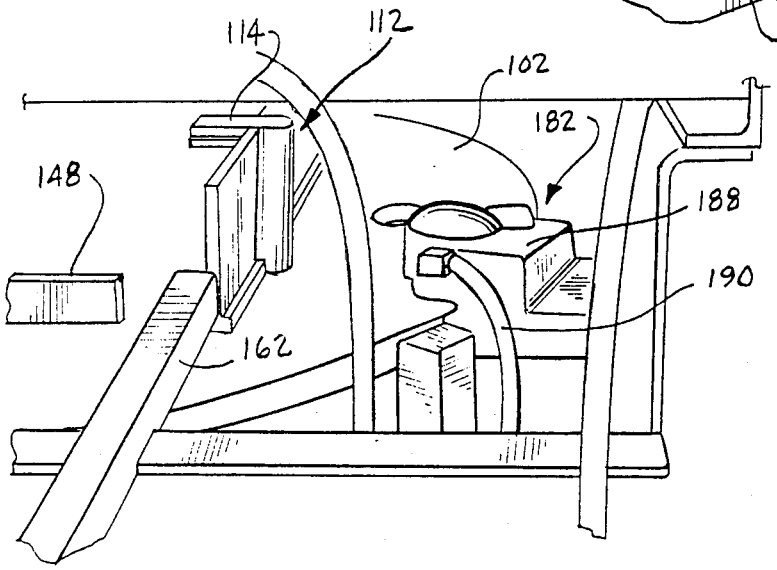
FIG. 7 is an enlarged, fragmentary, perspective view showing a portion of the turntable of the subassembly of FIG. 3.

A generally circular turntable 102 is nonrotatably secured to output shaft 80. Turntable 102 supports mold 36. A pair of opposed, elongated clamps including plates 110, 112 are supported on turntable 102. As seen, for example, in FIGS. 6 and 7, each plate 110, 112 includes inwardly facing arms or clamp jaws 114. Each plate 110, 112 has a pair of spaced shafts or tubes 116 secured to the arms 114 and hence to the plates 110, 112, respectively (FIGS. 1 and 6).

Figure 5:
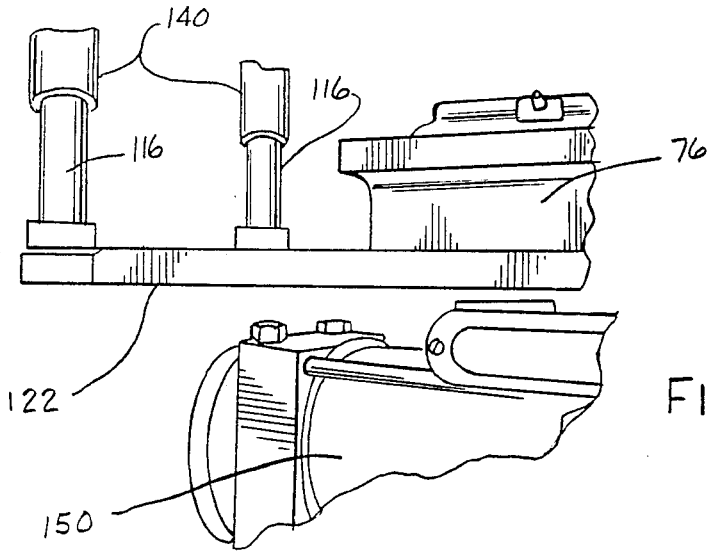
FIG. 5 is an enlarged, fragmentary, perspective view showing a portion of the apparatus of FIG. 3.

Provision is made for raising plates 110, 112 with respect to turntable 102 so that rectangular mold 36 may be placed in position on the turntable. As seen in FIGS. 1, 4 and 5, an actuator plate 122 encircles drive housing 76. Plate 122 is secured to piston cylinder actuators 126, 128. In FIGS. 1 and 5, actuators 126, 128 are shown in the lowered clamping position. Tubes 112 extend downwardly through suitable apertures in turntable 102 and through housings 140. As best seen in FIG. 5, when actuator 122 is in its lowered position, lower ends 142 of shafts 110, 112 are spaced from the upper surface of plate 122. Plates 110, 112 will hold the mold 36 on turntable 102 by gravity. Also secured to the upper surface of turntable 102 are opposed plates 146, 148. Clamps 110, 112 and plates 146, 148 in effect define a recess within which mold 36 is held during rotation of turntable 102.

A vibrator 150 is secured to support plate 72 (FIGS. 1 and 3). Vibrator 150 is a conventional item which includes a hydraulic or other drive for rotating an eccentric. Vibrator 150 causes frame 52 to vibrate or oscillate on rubber blocks 68.

As best seen in FIGS. 3 and 4, a plurality of guide bars 160, 162 are secured to the upper surface of housing 62 and extend outwardly therefrom. Extending across the top of housing 62 transversely to bars 160, 162 is a subframe 168. Supported on subframe 168 is a double-acting piston cylinder actuator 170. Actuator 170 shifts a mold loader 172 parallel to bars 160, 162. Loader 172 includes a hinged, depending plate 174. In use, a mold 36 is slid onto bars 160, 162. The mold will engage plate 174 which will pivot towards the turntable until the mold clears. At this point, plate 174 will pivot behind the mold. Actuation of piston cylinder 170 will shift loader 172 towards turntable 102 and push the mold along bars 160, 162 and into position between clamping plates 110, 112 and opposed plates 146, 148. When a new mold is fed onto the turntable, the mold which has previously been filled and rotated is pushed up and off the turntable on guide bars 160, 162 extending opposite loader 172. Subassembly 12 also includes a turntable brake generally designated 182 in FIG. 7. Brake 182 is a disc brake subassembly including a caliper 188. A hydraulic line 190 directs fluid to caliper 188 to shift brake pads into engagement with turntable 102.

Mold

Figure 8:
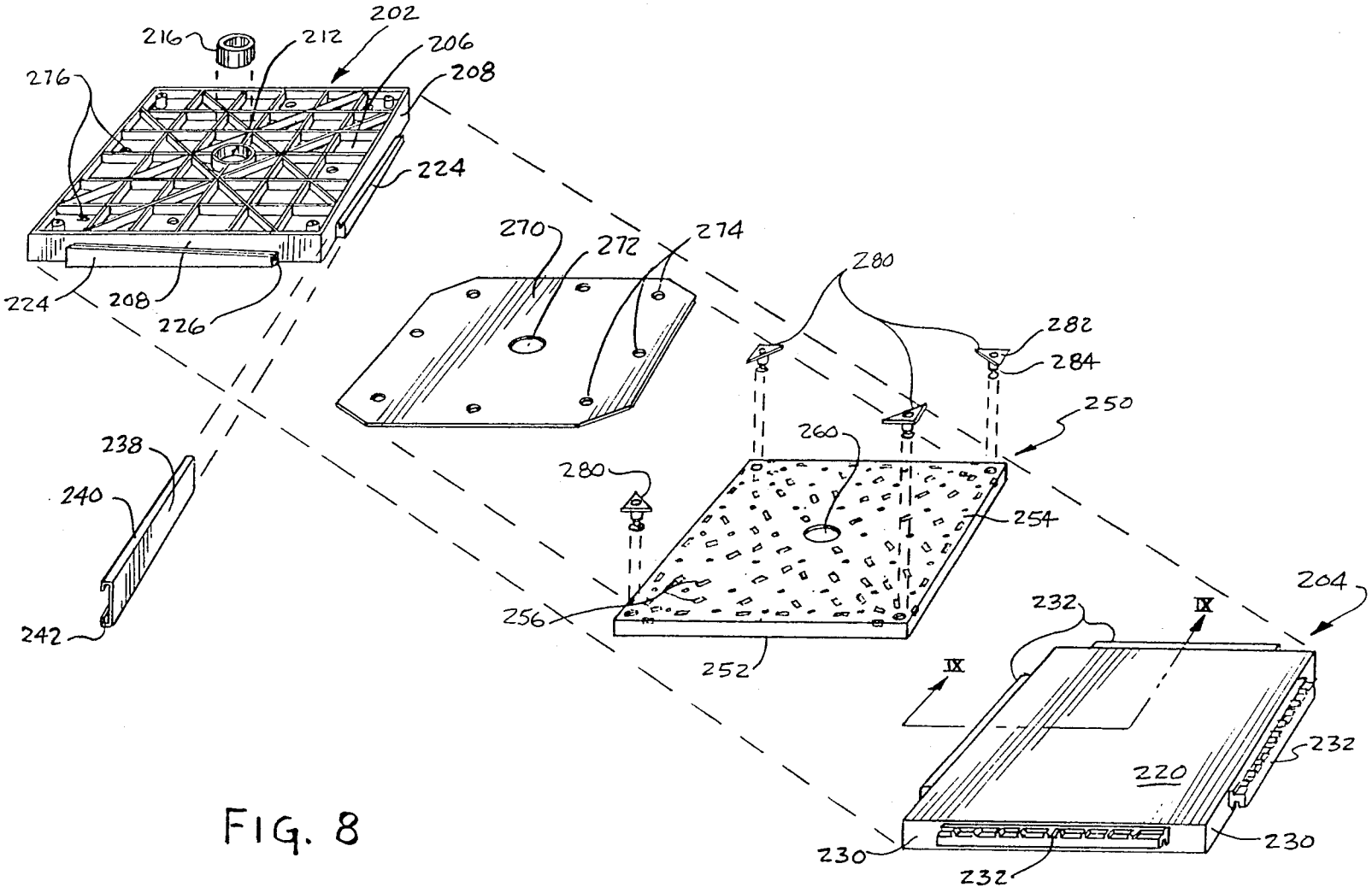
FIG. 8 is an exploded, perspective view showing a form of mold in accordance with the present invention.
Figure 9:
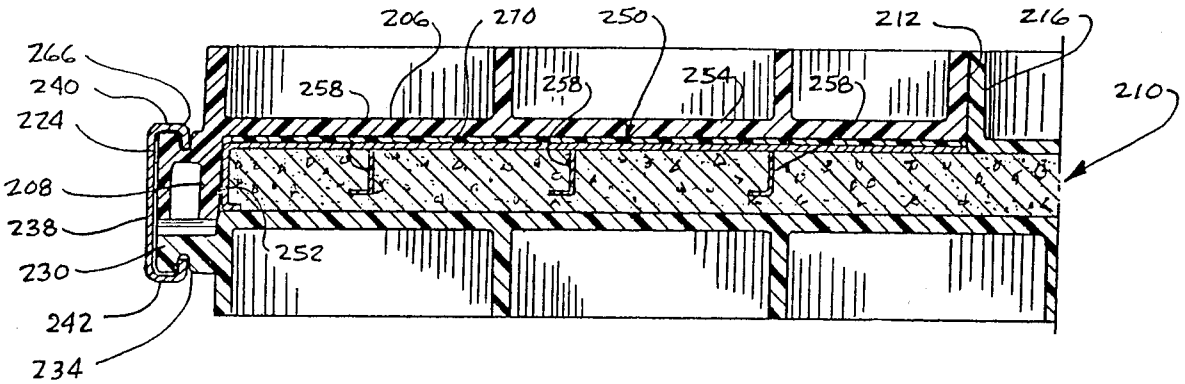
FIG. 9 is a cross-sectional view of the assembled mold taken generally along line IX—IX of FIG. 8.

A form of a thin cavity rectangular mold 36 usable with the present invention is illustrated in FIGS. 8 and 9. Mold 36 includes a first mold half 202 and a second mold half 204. Mold half 202 includes a bottom 206 and peripheral sidewalls 208. Mold half 202 defines a generally rectangular cavity 210. Mold half 202 defines a centrally located filling aperture 212 which opens through bottom 206 and into cavity 210. Aperture 212 is closed by a cylindrical plug 216 after the mold is filled with a cement mixture.

Mold half 204 defines a planar, substantially flat upper surface 220. Mold halves 202, 204 must be fabricated from a sufficiently rigid material so that they do not flex during the casting operation. Flexing prior to curing of the concrete mixture may result in warping of the resulting floor panels. The molds may be precision fabricated from aluminum.

Extending along sidewalls 208 of upper mold half 202 are elongated, channel-shaped clamp members 224. Each member 224 defines an upwardly opening groove 226. Also, each member 224 is generally wedge-shaped in side elevation. Lower mold half 204 around its peripheral sides 230 includes a plurality of cooperating, elongated members 232. Each member 232 defines a downwardly opening groove 234. As seen in FIGS. 8 and 9, mold halves 202, 204 are clamped together in a rigid fashion by a channel-shaped member 238. Member 238 includes inwardly facing and opposed flanges 240, 242. Member 238 is generally wedge-shaped in side elevation. Flanges 240, 242 are driven into and along grooves 226, 232, respectively.

The enclosed recess 210 defined by the clamped mold halves 202, 204 is precisely dimensioned to receive a stamped metal pan 250. The thickness of the mold recess or cavity 210 is on the order of one-half inch to two and one-half inches. Pan 250 is described in more detail in commonly owned, copending application Ser. No. 519,468, filed Aug. 4, 1983 and now U.S. Pat. No. 4,606,156. To the extent necessary, the disclosure of such application is hereby incorporated by reference. Pan 250 includes peripheral sidewalls 252 and a bottom 254. Bottom 254 is lanced to define a plurality of apertures 256 (FIG. 8). The lancing operation creates a plurality of tabs 258 (FIG. 9). The tabs extend in quadrants generally radially outwardly from the central portion of bottom 254. Bottom 254 also defines a central aperture 260. Aperture 260 is coaxial with aperture 212 of mold half 202. Aperture 260 has a diameter which corresponds to the diameter of aperture 212.

With prior methods of encapsulating the tabs formed by lancing pan 250, difficulties were experienced with complete encapsulation and the avoidance of any inclusions within the resulting core. Also, problems are experienced with seepage of the mix through lanced openings 256. In accordance with the present invention, a generally rectangular, flexible sheet 270 is sandwiched between the inner surface of bottom 206 of mold half 202 and the outer surface of bottom 254 of pan 250. Sheet 270 is a flexible, rubber-like material which has magnetic material embedded therein. The sheet, therefore, will adhere to bottom surface 254 of pan 250. As seen in FIG. 9, sheet 270 is disposed within recess 210 and against bottom 254. Sheet 270 also defines a central aperture 272 which is coaxially aligned with apertures 212 and 258. Sheet 270 defines a plurality of ejection apertures 274. Apertures 274 are aligned with ejection apertures 276 defined by bottom 206 of mold half 202.

In making up mold 36, sheet 270 is disposed within recess 210. A plurality of corner core pads or corner inserts 280 (FIGS. 8 and 11) are then disposed in each of the four corners of recess 210. Inserts 280 include a generally triangular pad portion 282 and a central core portion 284. Each core portion 284 extends through a corner or core aperture 286 defined by pan 250. Pan 250 with inserts 280 in place is then slip fit into recess 210. Mold half 204 is placed in position with respect to half 202. The two halves are then clamped together, as described above. The made up mold 36 is then positioned on turntable 102 of centrifugal casting subassembly 12. Mold 36 is held in place by opposed jaws or clamps 110, 112 and opposed plates 146, 148. Sprue 34 is positioned at aperture 212 and the concrete mixture is metered from hopper 14 and into the mold. Variable speed motor 86 is actuated and turntable 102 is rotated about its vertical axis defined by shaft 80. Shaft 80 is coaxial with apertures 212, 258 and 272 of mold half 202, pan 250 and sheet 270, respectively. As mold 36 is rotated, the cement mixture is centrifugally spread or cast throughout recess 210 now defined by pan 250 and bottom mold half 204. In order to insure an inclusion-free core within the pan, vibrator 150 is actuated. The speed of rotation of turntable 102 is steadily increased during the filling operation. The pan cavity is completely filled and the concrete mix is compacted due to centrifugal force within the pan.

Once the filling and casting operation is complete, turntable 102 is braked. Mold 36 is then ejected from the centrifugal casting subassembly. Core plug 216 is placed in sprue aperture 212 of mold half 202. After the concrete mix cures within the mold, wedges 238 are removed from mold halves 202, 204. Ejection pins are used to push the composite access floor panel from recess 210 of mold half 202. Magnetic sheet 270 insures that bottom 254 of pan 250 is weep free. All of the concrete mix is retained within the pan. Subsequent material removal operations are not necessary. The method and apparatus results in significant labor savings, increased production and increased quality.

Figure 10:
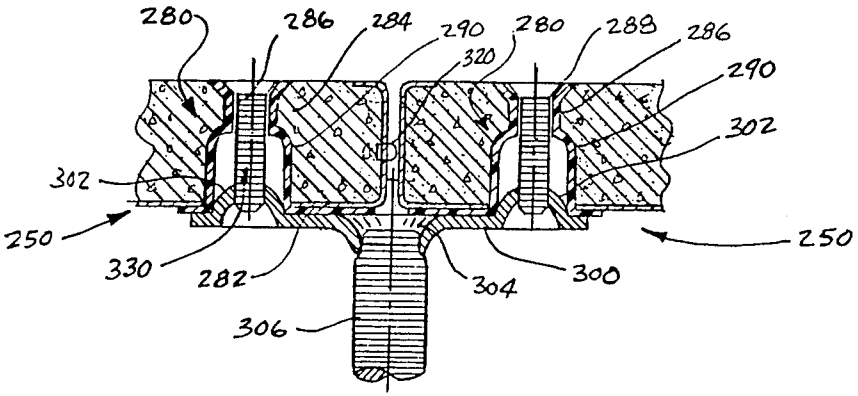
FIG. 10 is a fragmentary, cross-sectional view illustrating two adjacent access floor panels fabricated in accordance with the present invention disposed on a pedestal head.
Figure 11:
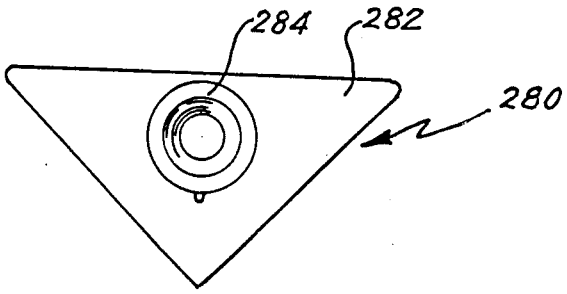
FIG. 11 is a top, plan view of a corner insert employed in the present invention.

As seen in FIG. 10, corner pads or inserts 280 are completely encapsulated by concrete mixture 292. Pad portions 282 are generally triangular and are configured to match the corners of pan 250 (FIG. 11). Core portion 284 defines a reduced diameter portion 286, a beveled portion 288 and an enlarged portion 290. The inserts are preferably fabricated from a statically conductive plastic material, such as polypropylene.

Figure 12:
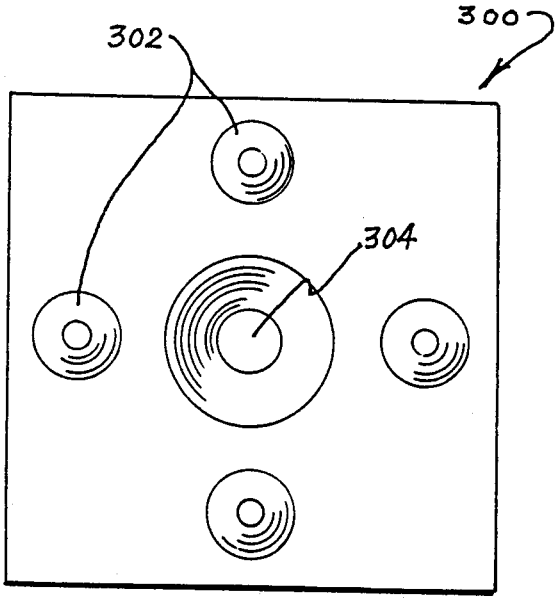
FIG. 12 is a top, plan view of a pedestal head or plate employed in the present invention.

Corner inserts 280 cooperate with a pedestal head or plate 300. As seen in FIGS. 10 and 12, pedestal plate 300 is rectangular in plan. Plate 300 defines four equally spaced, semispherical portions 302. Portions 302 are dimensioned to be received within the enlarged bore portions 290 of corner inserts 280. Plate 300 also defines a central extruded aperture 304 at which the plate is threaded and welded to a pedestal 306. Each plate 300 supports adjacent corners of four access floor panels.

The pads or inserts 280 provide a plastic-to-metal contact at the support pedestals. This eliminates noise and rocking of the panels. In addition, spacer buttons 320 (FIG. 10) are inserted through sidewalls 252 of pan 250 at diagonally opposite points. Silencer buttons 320 are fabricated from a plastic or rubber material. As seen in FIG. 10, the buttons contact an adjacent panel. This also eliminates noise by preventing metal-to-metal contact. A fastener 330 cuts threads in reduced portion 286 of each corner insert. Fastener 330 is threaded into semispherical portion 302 of pedestal plate 300. Fastener 330 includes an unthreaded portion 331. When in the position shown in FIG. 10, the threads of fastener 330 do not engage the threads it has cut in portion 286 of insert 280. This reduces the chance of the fastener unintentionally backing out. The pedestal plates and cooperating corner pads incorporated in the present invention provide lateral stability at the tops of the pedestals. The pads and hence the panels are locked to the pedestal plates. This eliminates the need for stringers or elongated channel members extending between the pedestals. Such are no longer necessary for lateral stability.

As a result of the present invention, costly and time-consuming labor intensive operations are eliminated. A complete, inclusion-free core is formed within each of metal pans 250 defining the access floor panels. The tabs defined by pan 250 are completely encapsulated. This results in a composite structure and increased strength and reliability in use.

In view of the foregoing description, those of ordinary skill in the art will undoubtedly envision various modifications to the present invention which would not depart from the inventive concepts disclosed herein. The present invention provides a highly efficient apparatus and method for centrifugally casting articles employing thin cavity molds. It is therefore expressly intended that the above description should be considered as only that of the preferred embodiments. The true spirit and scope of the present invention may be determined by reference to the appended claims.

The embodiments of the invention in which an exclusive property or privilege is claimed are defined as follows:

1. A method of making concrete access floor panels adapted to be supported on pedestals, said method comprising the steps of:

forming a metal pan having a planar bottom defining openings and peripheral sidewalls;

inserting the metal pan into a two-part mold, said mold including a part defining a thin mold cavity having a cavity bottom and cavity sidewalls dimensioned to receive the metal pan in a slip fit fashion and said mold including another part defining a flat surface facing said mold cavity;

placing a smooth magnetic sheet within said mold cavity against said cavity bottom and between said cavity bottom and said planar bottom of said metal pan, said sheet dimensioned and disposed to engage the planar bottom of the metal pan to prevent seepage of a concrete mixture through the openings in the planar bottom during casting;

filling the pan within the mold with the concrete mixture;

clamping the mold parts together;

rotating the mold about an axis; and vibrating the mold while it is being rotated to evenly distribute the concrete mixture within the pan.

2. A method as defined by claim 1 further including the step of clamping the mold to a turntable and wherein said rotating step includes the step of rotating said turntable.

3. A method as defined by claim 1 further including the step of inserting pedestal corner pads into the mold cavity at four corners thereof with each of the pads having a portion extending into said pan through the bottom thereof.

4. A method as defined by claim 3 further including the step of inserting spacer buttons into the sidewalls of said pan at generally diagonal positions.

* * * * *